US005172767A

United States Patent [19]

Turner et al.

[11] Patent Number: 5,172,767

[45] Date of Patent: Dec. 22, 1992

[54] WATER SPRAY CONTROL SYSTEM FOR UNDERGROUND MINING MACHINE

[75] Inventors: Robert P. Turner, Hotchkiss; Jason D. Gallob, Paonia, both of Colo.

[73] Assignee: Atlantic Richfield Company, Los Angeles, Calif.

[21] Appl. No.: 718,715

[22] Filed: Jun. 21, 1991

[51] Int. Cl.[5] ..... A62C 3/02

[52] U.S. Cl. ..... 169/43; 169/19; 169/60; 169/61; 169/64

[58] Field of Search ..... 169/19, 43, 45, 46, 169/56, 60, 61, 62, 64

[56] References Cited

U.S. PATENT DOCUMENTS 3,515,217 6/1970 Jamison ..... 169/64 X 3,684,021 8/1972 Poitras ..... 169/64 X

FOREIGN PATENT DOCUMENTS 395572 8/1973 U.S.S.R. ..... 169/64

*Primary Examiner*—Margaret A. Focarino
*Assistant Examiner*—Andrew C. Pike
*Attorney, Agent, or Firm*—Michael E. Martin

[57] ABSTRACT

A fire suppression water spray array for an underground mining machine includes an accumulator, and a normally open electrically operated valve interconnected in the machine hydraulic control system for operating a hydraulically operated water spray control valve to initiate the water spray in the event of interruption of electrical power to the machine.

5 Claims, 2 Drawing Sheets

WATER SPRAY CONTROL SYSTEM FOR UNDERGROUND MINING MACHINE

BACKGROUND OF THE INVENTION

1. Field of the Invention

The present invention pertains to an automatic water spray control system for fire suppression in the vicinity of underground coal mining machinery and the like.

2. Background

Underground coal mining machines, such as so-called continuous mining-type machines, are typically equipped with an arrangement of water spray nozzles connected to a source of high-pressure water for control of dust and for fire suppression in the event of ignition or eruption of fire in the vicinity of the machine. Underground mining machines, typically, also use electricity as a primary source of power and have hydraulic systems for operating various machine functions and for controlling a dust suppression water spray nozzle array and a fire suppression water spray nozzle array.

One shortcoming of conventional systems is that, in the event of a failure of the electrical power supply system to the mining machine, hydraulically operated control valves will not function to initiate operation of the fire suppression water sprays, in particular. Moreover, if the mining machine is located in an area of the mine which is beyond safe limits of operator access, the machine cannot be reached for manual operation of the water sprays. In this regard, the present invention provides an improved water spray control system which is adapted to operate fire suppression water sprays, in particular, in the event of a failure or shutoff of the electrical power system which would normally also cause a failure or shutdown of a hydraulic fluid power and control system.

SUMMARY OF THE INVENTION

The present invention provides an improved control system for controlling the initiation of water sprays for suppressing or minimizing the chance of fire on or in the vicinity of an underground mining machine. In accordance with one aspect of the present invention, a control circuit is provided for operating a water spray control valve which is hydraulically actuated and which will effect initiation of water sprays in the event of failure or shutoff of an electrical power supply to or on the mining machine.

In accordance with another important aspect of the present invention, a water spray control system is provided which is particularly adapted for underground mining machines, wherein a hydraulically operated water spray shut-off valve may be actuated by a source of hydraulic fluid including an accumulator and a normally open electrically-operated valve which will provide a supply of hydraulic fluid to the water spray control valve in the event of electrical power interruption to the mining machine. Accordingly, in the event of failure of the machine hydraulic system due to electrical power interruption or other systemic failures, a sufficient supply of fluid is provided by the present invention to operate a fire suppression water spray control valve to initiate the flow of water to the spray nozzle array.

Those skilled in the art will recognize the above-described advantages and features of the present invention as well as other superior aspects thereof upon reading the detailed description which follows in conjunction with the drawing.

DESCRIPTION OF A PREFERRED EMBODIMENT

Figure 1:
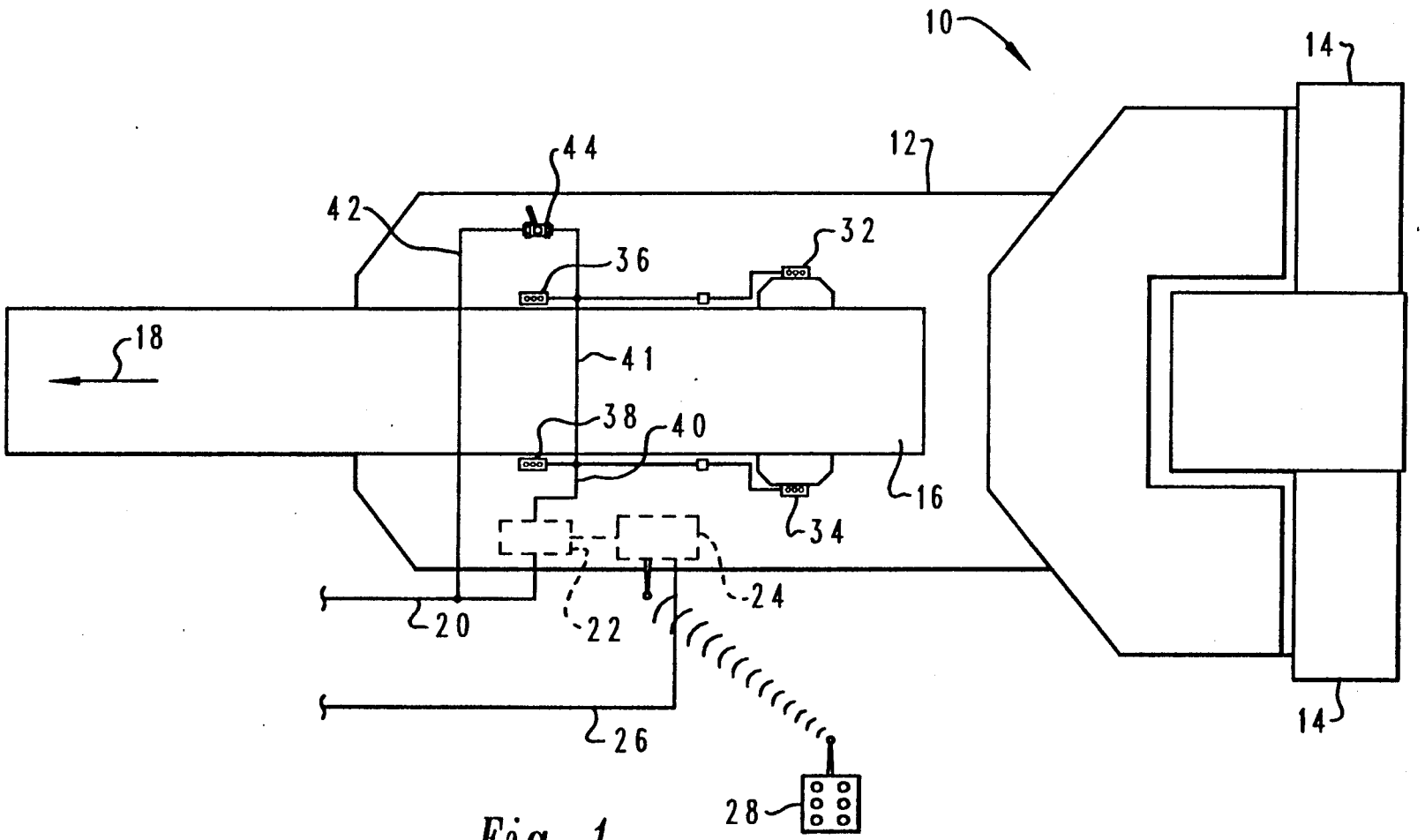
FIG. 1 is a plan view, in somewhat schematic form, of an underground coal mining machine including an arrangement of fire suppression water sprays and which advantageously utilizes the control system of the present invention.

In the description which follows, like parts are marked throughout the specification and drawing with the same reference numerals, respectively. The drawing figures are not to scale and a substantial number of components are illustrated in schematic form utilizing standard symbols.

Referring to FIG. 1 there is illustrated in plan view an "outline" of an underground, so-called continuous-type mining machine, generally designated by the numeral 10. The mining machine 10 may be one of several configurations but for illustrative purposes includes a frame 12, on which are mounted spaced apart rotary cutter heads 14 which operate to cut into a coal seam and to convey the cut coal pieces onto a conveyor 16 for movement of the produced coal away from the machine in the direction indicated by the arrow 18. The mining machine 10 may take on various forms and the particular machine illustrated and described is for illustrative purposes only. Suffice it to say that machines of the type represented by the machine 10 are operated in underground mines to cut into coal seams and are typically remotely controlled so that the machine operator may stand a relatively safe distance from the machine during its operation.

The machine 10 is also supplied with fire and dust suppression control water from a supply hose 20 which is connected to a bank of control valves, represented in FIG. 1 as being disposed in an enclosure 22, or otherwise grouped closely on the machine. In like manner, electrical controls, including a radio receiver, are typically mounted on the machine frame 12 within an enclosure or envelope 24 to which is connected an electrical cable 26 for supplying electric power to the machine 10. A remote radio transmitter type controller apparatus 28 is adapted to control the machine operation, including control of water sprays, operation of the cutter heads, and other functions. The controller 28 may also be operated to remotely shut off electrical power to the machine operating controls and devices. The controller 28 may also be connected to the machine by an elongated control cable, not shown, instead of utilizing radio control signals.

The mining machine 10 is provided with an array of water spray nozzles including sets of nozzles 32, 34, 36, and 38 which are connected to water supply conduits 40 and 42, including a crossover conduit 41. The supply conduit 40 is also connected to the enclosure or control valve bank 22 which will be disclosed in further detail herein. The conduit 42 is connected to the main water supply 20 and includes a manually actuated valve 44 interposed therein for manually controlling the operation of the spray nozzle arrays 32, 34, 36, and 38 from one side of the machine 10. As will be described in further detail herein, a second manually operated valve for the fire suppression water spray nozzle array is located in the vicinity of the enclosure 22 for manually initiating the water spray from the side of the machine opposite the side at which the valve 44 is located.

Figure 2:
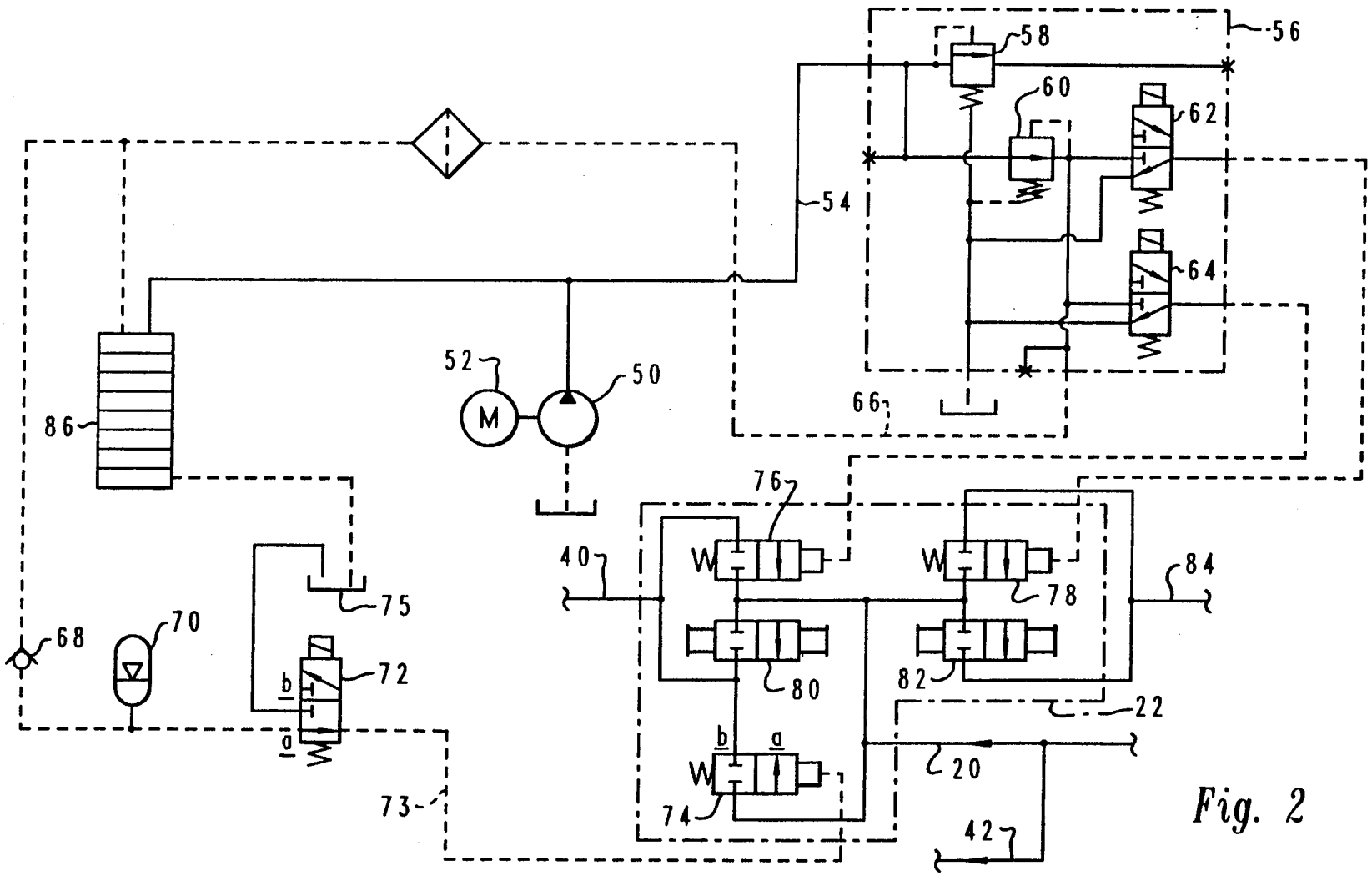
FIG. 2 is a schematic diagram of a hydraulic control circuit for the machine illustrated in FIG. 1 and including the improved water spray control arrangement of the present invention.

Referring now to FIG. 2, the control system for the machine 10 typically includes a hydraulic fluid pump 50 driven by an electric motor or the like 52. The pump 50 supplies hydraulic fluid by way of a conduit 54 to a valve manifold 56 which supplies hydraulic fluid to pressure regulator valves 58 and 60. The pressure regulator valve 60 supplies pressure fluid to solenoid operated valves 62 and 64 and to a conduit 66. The conduit 66 is in communication with a check valve 68, an accumulator 70, and a solenoid operated, normally open valve 72. The valve 72 is operable to supply hydraulic fluid to a pilot operated control valve 74 which is interposed in a conduit connected to the main water supply conduit 20 for supplying water to the spray nozzles 32, 34, 36, and 38 by way of the conduit 40, as illustrated.

The enclosure 22 includes pilot pressure fluid operated control valves 76 and 78 which are operable to be opened by pilot pressure fluid from the valves 64 and 62, respectively, when the valves 64 and 62 are electrically energized by suitable remote controls such as on the controller 28. The enclosure 22 still further includes manually operated values 80 and 82 which are in communication with the main water supply conduit 20 so that water may be conducted to the fire suppression spray array by way of the conduit 40 and to a dust suppression water spray array, not shown, by way of a conduit 84. Hydraulic fluid is also supplied by the pump 50 to a control valve bank generally designated by the numeral 86 for operating certain control valves to control some of the primary functions of the machine 10 which will not be discussed in further detail herein.

Accordingly, in the normal operation of the machine 10, hydraulic fluid is supplied by the pump 50 to the pilot fluid control valves 62 and 64 and these valves may be operated by remote control to open the valves 78 and 76, respectively, to supply water to the fire suppression water spray array and to the aforementioned dust suppression water spray array by way of the conduits 40 and 84, respectively. Still further, the fire suppression water spray array may be furnished with water by way of the conduit 20 and the manually operated valves 44 and 80. As indicated by the diagram of FIG. 2, the manually operated valve 82 may also be actuated to supply water from the conduit 20 to the conduit 84 leading to the dust suppression spray array, not shown. Accordingly, if operating personnel are adjacent the machine 10, on either side thereof, the valves 44 and 80 are usually easily accessible for turning on the fire suppression water spray array. Still further, if an operator is in the vicinity of the valve 48, FIG. 1, the fire suppression water spray array may also be remotely turned on and off.

As previously mentioned the machine operator may remotely control the valves 64 and 62, provided electrical power is available, to open the valves 76 and 78. However, if electrical power should fail or be purposely shut off in an emergency, or the cable 26 cut thereby preventing control of the machine 10, the fire suppression water spray arrays will be operated thanks to the provision of the valve 72 and the accumulator 70 which supply pressure fluid by way of conduit 73 to the pilot operated control valve 74. For example, if electrical power to the machine 10 should be interrupted, the valve 72 will move to the open position a discharging hydraulic fluid from the accumulator 70 through the conduit 73 to effect movement of the valve 74 to the open or a position to supply water to the conduit 40 and the nozzle arrays 32, 34, 36, and 38. With electrical power normally available to the machine 10, the valve 72 will be in its position b to vent the conduit 73 through the valve 72 back to a hydraulic fluid reservoir or tank 75. The valve 74 will remain in the closed or b position.

Thanks to the arrangement of the check valve 68, accumulator 70, control valve 72, and the pilot operated control valve 74, fire suppression water may be supplied to the machine 10 in the event of electrical power interruption. Moreover, conventional mining machines with hydraulic control systems generally along the lines illustrated in FIG. 2 may be easily adapted to operate with the system of the present invention by connecting the conduit 73 to a source of pilot pressure fluid such as supplied in the conduit 66 and by interconnecting a water control valve with the main water supply conduit 20 and with the conduit leading to the fire suppression water spray nozzles.

Operation of the system illustrated is believed to be readily understandable to those of ordinary skill in the art from the foregoing description. The components, particularly the check valve 68, accumulator 70, valve 72, and valve 74 are readily commercially available or are believed to be within the purview of the art worker to fabricate and furnish in accordance with conventional hydraulic control system or fluid power practices.

Although a preferred embodiment of the present invention has been described in detail herein, those skilled in the art will recognize that various substitutions and modifications may be made to the invention without departing from the scope and spirit of the appended claims.

What is claimed is:

1. In a mining machine having a water spray array operable to minimize ignition or propagation of fire, a water spray supply conduit connected to said spray array, a main water supply conduit adapted to be connected to a source of water, and a source of pressure fluid, the improvement comprising:

a control valve interposed between said main water supply conduit and said water spray supply conduit, said control valve being pressure-fluid operated to supply the water to said spray array;

an electrically operated valve; and conduit means connecting said source of the pressure fluid to said electrically operated valve and said electrically operated valve to said control valve, respectively, for supplying the pressure fluid to effect operation of said control valve to supply the water to said water spray array in an event of interruption in a supply of electrical power to said electrically operated valve.

2. The invention set forth in claim 1, further including:

accumulator means interposed in said conduit means between said source of the pressure fluid and said electrically operated valve for supplying the pressure fluid to said control valve when said electrically operated valve is in the open position.

3. The invention set forth in claim 2, further including:

check valve means interposed in said conduit means between said source of the pressure fluid and said accumulator means.

4. In a mining machine having a water spray array operable to minimize ignition or propagation of fire, a water spray supply conduit connected to said spray array, a main water supply conduit, and a source of pressure fluid, the improvement comprising:

a control valve interposed between said main water supply conduit and said water spray supply conduit, said control valve being pressure-fluid operated to open to supply water to said spray array;

a power operated valve;

conduit means connecting said source of the pressure fluid to said power operated valve and said power operated valve to said pressure-fluid operated control valve, respectively, for supplying the pressure fluid to effect operation of said control valve to supply the water to said spray array in an event of interruption in power to said power operated valve; and accumulator means for supplying the pressure fluid to said control valve by way of said power operated valve when said power operated valve is in an open position.

5. A method of modifying a mining machine to provide automatic initiation of a fire suppression water spray in an event of electrical power interruption, said mining machine including a hydraulic control system including a source of hydraulic fluid, a source of pressure water including a main water supply conduit, and an array of fire suppression water spray nozzles connected to a water spray conduit operable to receive the pressure water from said main water supply conduit, said method comprising the steps of:

providing electrically operated normally open valve means, normally closed valve means having a hydraulic fluid energized pilot operator, accumulator means, check valve means, and conduit means for conducting the hydraulic fluid to said pilot operator;

connecting said conduit means to said source of the hydraulic fluid on said mining machine and placing said check valve means in said conduit means;

placing said normally open valve means in said conduit means;

placing said accumulator means in communication with said conduit means between said check valve means and said normally open valve means;

placing said normally closed valve means in a water supply conduit between said main water supply conduit and said water spray conduit; and connecting said conduit means to said pilot operator of said normally closed valve means.

* * * * *